US008162601B2

(12) United States Patent
Ochiai et al.

(10) Patent No.: US 8,162,601 B2
(45) Date of Patent: Apr. 24, 2012

(54) SURFACE TREATMENT METHOD AND REPAIR METHOD

(75) Inventors: Hiroyuki Ochiai, Koto-ku (JP); Mitsutoshi Watanabe, Koto-ku (JP); Takashi Furukawa, Koto-ku (JP); Issei Otera, Koto-ku (JP)

(73) Assignee: IHI Corporation, Tokyo (JP)

( * ) Notice: Subject to any disclaimer, the term of this patent is extended or adjusted under 35 U.S.C. 154(b) by 744 days.

(21) Appl. No.: 11/908,038

(22) PCT Filed: Mar. 9, 2006

(86) PCT No.: PCT/JP2006/304557

§ 371 (c)(1),
(2), (4) Date: Feb. 11, 2009

(87) PCT Pub. No.: WO2006/095799

PCT Pub. Date: Sep. 14, 2006

(65) Prior Publication Data

US 2009/0214352 A1 Aug. 27, 2009

(30) Foreign Application Priority Data

Mar. 9, 2005 (JP) ..... 2005-066300

(51) Int. Cl.
*F03B 1/04* (2006.01)

(52) U.S. Cl. ..... 415/200; 416/241 R; 29/889.1; 29/402.07; 427/580

(58) Field of Classification Search ..... 415/200; 416/241 R; 29/889.1, 402.07; 427/580, 427/140, 142

See application file for complete search history.

(56) References Cited

U.S. PATENT DOCUMENTS

| | | | | |
|---|---|---|---|---|
| 5,858,479 | A * | 1/1999 | Saito et al. | 427/580 |
| 6,086,684 | A * | 7/2000 | Saito et al. | 148/220 |
| 6,434,823 | B1 * | 8/2002 | Gupta et al. | 29/889.1 |
| 6,532,656 | B1 * | 3/2003 | Wilkins et al. | 29/889.1 |
| 6,588,103 | B2 * | 7/2003 | Fernihough et al. | 29/889.1 |
| 6,602,561 | B1 * | 8/2003 | Moro et al. | 427/580 |
| 6,676,741 | B2 * | 1/2004 | Phillips et al. | 106/417 |
| 6,783,795 | B2 * | 8/2004 | Inoue et al. | 427/8 |
| 6,793,982 | B1 * | 9/2004 | Yamada et al. | 427/580 |
| 6,808,604 | B1 * | 10/2004 | Goto et al. | 204/164 |

(Continued)

FOREIGN PATENT DOCUMENTS

JP 5 148615 6/1993

(Continued)

*Primary Examiner* — Ross Gushi

(74) *Attorney, Agent, or Firm* — Oblon, Spivak, McClelland, Maier & Neustadt, L.L.P.

(57) ABSTRACT

A method for forming a dense coating on a limited region of a subject body is disclosed. The method is composed of the steps of: applying one selected from the group of a compressed body of a powder of a metal and a sintered compressed body of a powder of a metal to a working electrode; executing discharge deposition to deposit a first coating from the working electrode on the subject body by applying the subject body as a workpiece of the discharge deposition; executing discharge deposition to deposit a second coating from the working electrode on the first coating by applying the subject body as a workpiece of the discharge deposition; and heating the subject body in one selected from the group of a vacuum, an air and an oxidizing atmosphere so as to densify the second coating or oxidizing the second coating at least in part to generate a solid lubricant substance.

10 Claims, 8 Drawing Sheets

U.S. PATENT DOCUMENTS

| | | | | |
|---|---|---|---|---|
| 6,811,379 | B2 * | 11/2004 | Fernihough et al. | 416/241 R |
| 6,821,579 | B2 * | 11/2004 | Yuzawa et al. | 427/580 |
| 6,929,829 | B2 * | 8/2005 | Mohri et al. | 427/540 |
| 6,935,917 | B1 * | 8/2005 | Goto et al. | 445/51 |
| 7,509,736 | B2 * | 3/2009 | Boudereau et al. | 29/889.1 |
| 7,537,809 | B2 * | 5/2009 | Ochiai et al. | 427/580 |
| 7,691,454 | B2 * | 4/2010 | Goto et al. | 427/580 |
| 7,723,636 | B2 * | 5/2010 | Ochiai et al. | 219/69.17 |
| 7,763,349 | B2 * | 7/2010 | Ochiai et al. | 428/317.9 |
| 7,776,409 | B2 * | 8/2010 | Goto et al. | 427/580 |
| 7,824,159 | B2 * | 11/2010 | Ochiai et al. | 416/241 R |
| 7,910,176 | B2 * | 3/2011 | Goto et al. | 427/580 |
| 7,915,559 | B2 * | 3/2011 | Goto et al. | 219/69.15 |
| 7,918,460 | B2 * | 4/2011 | Ochiai et al. | 277/412 |
| 2005/0063827 | A1 * | 3/2005 | Ochiai et al. | 416/241 R |
| 2005/0211165 | A1 * | 9/2005 | Goto et al. | 118/620 |
| 2006/0035068 | A1 * | 2/2006 | Ochiai et al. | 428/306.6 |
| 2006/0086617 | A1 * | 4/2006 | Goto et al. | 205/102 |
| 2006/0086695 | A1 * | 4/2006 | Goto et al. | 219/69.17 |
| 2006/0090997 | A1 * | 5/2006 | Goto et al. | 204/164 |
| 2006/0118402 | A1 * | 6/2006 | Goto et al. | 204/164 |
| 2006/0213777 | A1 * | 9/2006 | Goto et al. | 205/83 |
| 2006/0240184 | A1 * | 10/2006 | Ochiai et al. | 427/140 |
| 2007/0068793 | A1 * | 3/2007 | Goto et al. | 204/164 |
| 2007/0160469 | A1 * | 7/2007 | Ochiai et al. | 415/200 |
| 2007/0184298 | A1 * | 8/2007 | Ochiai et al. | 428/689 |
| 2008/0066646 | A1 * | 3/2008 | Ochiai et al. | 106/286.1 |
| 2008/0230374 | A1 * | 9/2008 | Goto et al. | 204/192.15 |
| 2008/0304975 | A1 * | 12/2008 | Clark et al. | 416/241 R |
| 2009/0214352 | A1 * | 8/2009 | Ochiai et al. | 416/241 R |
| 2009/0288809 | A1 * | 11/2009 | Shigyo et al. | 165/133 |
| 2010/0086398 | A1 * | 4/2010 | Ochiai et al. | 415/200 |
| 2010/0119864 | A1 * | 5/2010 | Ochiai et al. | 428/610 |
| 2010/0126871 | A1 * | 5/2010 | Shiino et al. | 205/115 |
| 2010/0180725 | A1 * | 7/2010 | Goto et al. | 75/236 |
| 2010/0200548 | A1 * | 8/2010 | Shiino et al. | 219/69.15 |
| 2010/0239841 | A1 * | 9/2010 | Ochiai et al. | 428/307.7 |
| 2010/0330302 | A1 * | 12/2010 | Watanabe et al. | 427/580 |
| 2011/0027099 | A1 * | 2/2011 | Ochiai et al. | 416/241 R |
| 2011/0135845 | A1 * | 6/2011 | Goto et al. | 427/580 |
| 2011/0300311 | A1 * | 12/2011 | Watanabe et al. | 427/580 |

FOREIGN PATENT DOCUMENTS

| | | |
|---|---|---|
| JP | 8 300227 | 11/1996 |
| JP | 2001-279465 | 10/2001 |
| JP | 2005 2882 | 1/2005 |
| JP | 2005 8942 | 1/2005 |
| WO | 2004 029329 | 4/2004 |

* cited by examiner (a)

(b)

(c)

(a)

(b)

(a)

(b)

SURFACE TREATMENT METHOD AND REPAIR METHOD

TECHNICAL FIELD

The present invention relates to a method using electric discharge for forming a coating or a buildup on a desired site of a workpiece such as a component of a gas turbine engine and a repair method therewith.

BACKGROUND ART

As a gas turbine engine carries out high-speed revolution under high temperatures, its components are required to have excellent performance in abrasion resistance, heat resistance and/or high-temperature corrosion resistance. Sites required to have such performance are limited in these components and also limited in surfaces thereof. Therefore, it is often executed to have proper materials such as ceramics formed as coatings on base members. As methods applicable thereto, PVD, CVD and thermal spraying can be exemplified, however, these methods may raise some technical problems in which some selected materials make it difficult to apply these methods, require very long time for processing, and require additional process steps such as masking of peripheries of subject sites so as to localize the coatings in the sites.

An art which uses discharge between an electrode and a workpiece to form a coating is disclosed in Japan Patent Application Laid-open No. H8-300227, A problem of this art is to often form a porous coating on any occasions depending on kinds of ceramics and/or operation conditions. As a porous coating is poor in bonding force among particles, it may be hard to ensure sufficient strength for the coating.

DISCLOSURE OF INVENTION

The present invention has an object for providing a method to use electric discharge for forming a dense coating or buildup of a ceramic.

According to a first aspect of the present invention, a method for forming a coating on a limited site of a subject body includes the steps of: applying one selected from the group of a compressed body of a powder of a metal and a sintered compressed body of a powder of a metal to a working electrode; executing discharge deposition to deposit a first coating from the working electrode on the subject body by applying the subject body as a workpiece of the discharge deposition; executing discharge deposition to deposit a second coating from the working electrode on the first coating by applying the subject body as a workpiece of the discharge deposition; and heating the subject body in one selected from the group of a vacuum, an air and an oxidizing atmosphere so as to density the second coating or oxidizing the second coating at least in part to generate a solid lubricant substance.

According to a second aspect of the present invention, a method for producing a product repaired from a subject body including a defect includes the steps of: removing a portion defining the defect of the subject body; applying one selected from the group of a compressed body of a powder of a metal and a sintered compressed body of a powder of a metal to a working electrode; executing discharge deposition to deposit a buildup from the working electrode on the subject body by applying the subject body as a workpiece of the discharge deposition; and heating the subject body in one selected from the group of a vacuum, an air and an oxidizing atmosphere so as to densify the buildup or oxidizing the deposition at least in part to generate a solid lubricant substance.

Preferably, either of the aforementioned methods may further include a step of filling a solid lubricant material in pores included in the coating before the step of heating. Further preferably, the solid lubricant material may consist essentially of one selected from the group of hBN, $MoS_2$, $BaZrO_3$ and $Cr_2O_3$. Still further preferably, either of the aforementioned methods may further include a step of filling a solid lubricant material in pores included in the coating before the step of heating.

Still preferably, a component for a gas turbine engine includes the subject body. Further still preferably, a gas turbine engine includes the component.

BEST MODE FOR CARRYING OUT THE INVENTION

Throughout the specification and claims, several terms are used in accordance with the following definitions. The term "discharge deposition" is defined and used as use of discharge in an electric spark machine for wearing an electrode instead of machining a workpiece to deposit a material of the electrode or a reaction product between the material of the electrode and a machining liquid or a machining gas on the workpiece. Further, the term "discharge-deposit" is defined and used as a transitive verb of the term "discharge deposition". Furthermore, the phrase "consist essentially of" means to partially closely regulate ingredients, namely, to exclude additional unspecified ingredients which would affect the basic and novel characteristics of the product defined in the balance of the claim but permit inclusion of any ingredients, such as impurities, which would not essentially affect the characteristics.

In certain embodiments of the present invention, an electric spark machine (most of it will be not shown) is used for executing discharge deposition, In discharge deposition, a subject body is set in an electric spark machine as a workpiece thereof, and made closed to a working electrode in a processing bath. Then, in a case of general spark machining, pulsing current is supplied from an external power source to generate pulsing discharge between the workpiece and the working electrode so as to wear the workpiece, thereby the workpiece is machined into a shape complementary to a tip of the working electrode. In contrast, in the discharge deposition, the working electrode instead of the workpiece is worn and a material of the working electrode, or a reaction product between the material of the electrode and a machining liquid or a machining gas is made deposited on the workpiece. The deposit thereby is not only adhered on the workpiece but also may simultaneously undergo phenomena diffusion, weld and such between the deposit and the workpiece and further among particles in the deposit mutually by using energy of the discharge in part.

A first embodiment of the present invention will be described hereinafter with reference to FIG. 1 through FIG. 4.

Figure 1:
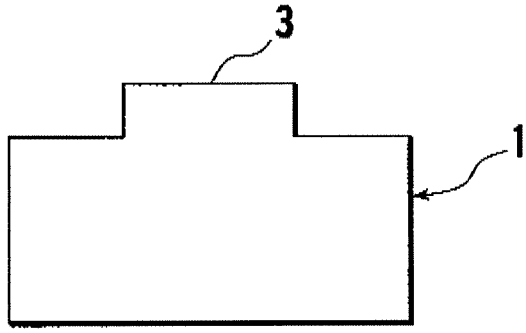
FIG. 1(*a*) is a schematic drawing of a subject body in accordance with a first embodiment of the present inventions and FIGS. 1(*b*) (*c*) are drawings explaining a surface treatment method with respect to the subject body.
Figure 1:
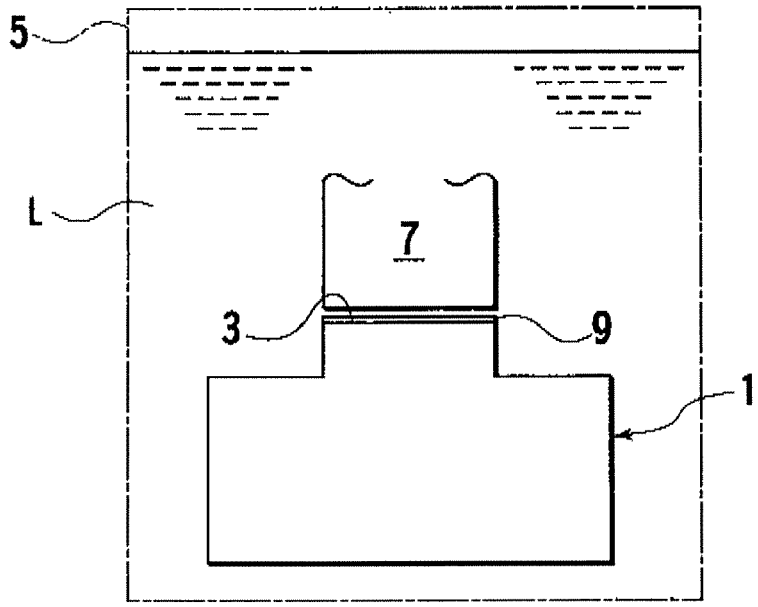
Figure 1:
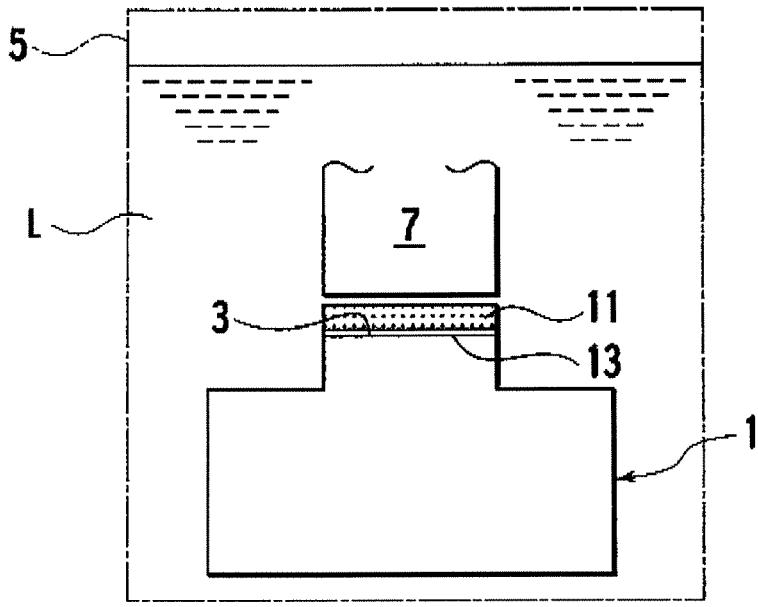

A surface treatment method in accordance with the first embodiment of the present invention is a method for treating a subject portion 3 of a subject body 1 as shown in FIG. 1(*a*) with a surface treatment and includes the following steps of a (I) thin-film formation step, a (II) buildup layer formation step, a (III) lubricant filling step, and a (IV) high-temperature keeping step.

(I) Thin-Film Formation Step

As shown in FIG. 1(*b*), the subject body 1, as a workpiece of the electric spark machine, is made closed to a working electrode 7 in a processing bath 5 of the electric spark machine. Then pulsing discharge is generated between the subject portion 3 of the subject body 1 and the working electrode 7 in an oil L stored in the processing bath 5. Thereby, a deposition by discharge deposition is formed as a thin film 9 on the subject portion 3 of the subject body 1.

Here, the working electrode 7 is a molded body made by pressing a powder consisting essentially of a metal or the molded body treated with heat treatment so as to be sintered at least in part. Meanwhile, the working electrode 7 may be formed by slurry pouring, MIM (Metal Injection Molding), spray forming and such, instead of pressing (II) Buildup Layer Formation Step After finishing the (II) thin-film formation step, as shown in FIG. 1 (*c*), pulsing discharge is further generated between the subject portion 3 of the subject body 1 and a tip surface of the working electrode 7 in the oil L in the processing bath 5. Thereby, the thin film 9 is further made grow to form a buildup layer 11 on the subject portion 3 of the subject body 1. The buildup layer 11 usually has a porous structure.

Further, at a boundary between the buildup layer 11 and a base of the subject body 1, a fusion part (fusion layer) 13 in which the composition ratio grades in its thickness direction is formed. The fusion part 13 is so constituted as to be 3 μm or more and 20 μm or less in thickness by selecting a proper discharge condition at a time of formation of the buildup layer 11. Meanwhile, the proper discharge condition may be that a peak current is 30 A or less and a pulse width is 200 μs or less, and more preferably that a peak current is 20 A or less and a pulse width is 20 μs or less.

Figure 3:
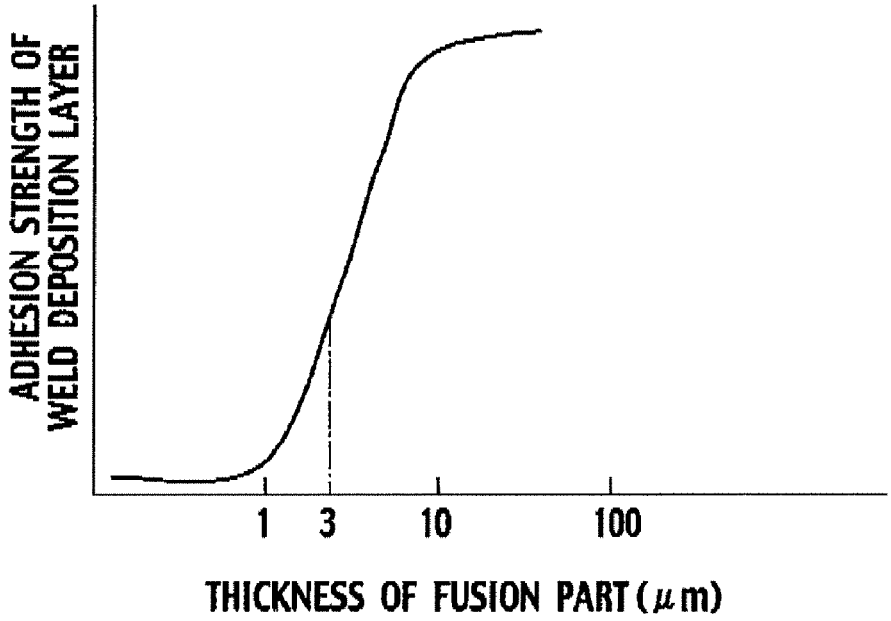
FIG. 3 is a drawing showing a relation between thickness of a fusion part and adhesion strength of a buildup in a case where the buildup is formed on the subject body by means of the surface treatment method.
Figure 4:
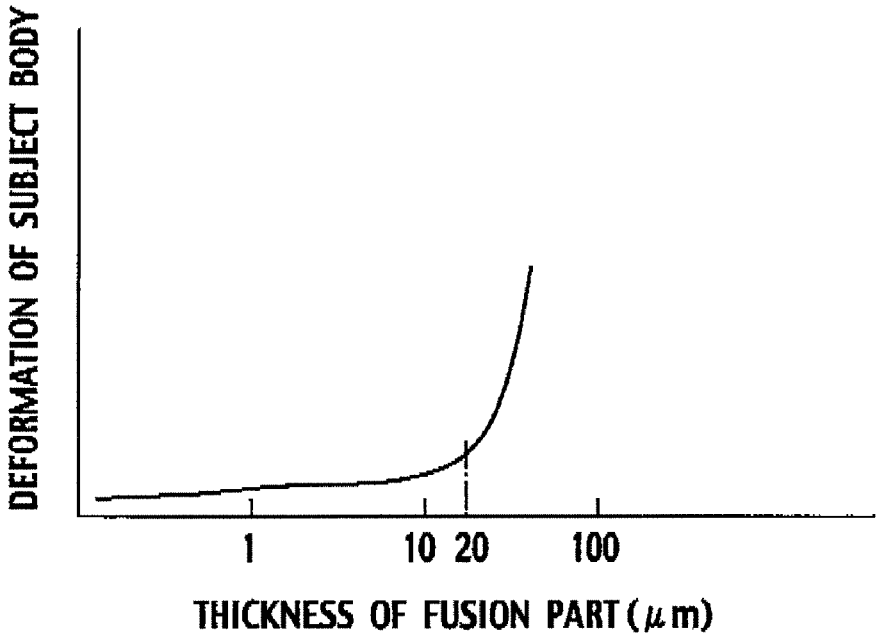
FIG. 4 is a drawing showing a relation between thickness of a fusion part and deformation of the subject body in a case where the buildup is formed on the subject body by means of the surface treatment method.

Here, a ground on which the thickness of the fusion part 13 is 3 μm or more and 20 μm or less is based on test results shown in FIG. 3 and FIG. 4.

More specifically, in a case where buildup layers 11 are formed on subject bodies 1 by means of discharge deposition on various discharge conditions, a relation between thickness of the fusion parts 13 and adhesion strength of the buildup layers 11 is as shown in FIG. 3. A novel first knowledge that the adhesion strength of the fusion parts 13 to the buildup layers 11 goes larger when the thickness of the fusion parts 13 is 3 μm or more could be obtained. Further, as the relation between the thickness of the fusion parts 13 and the deformation of the base of the subject body 1 is as shown in FIG. 4, a novel second knowledge that deformation of the base of the subject body 1 can be suppressed when the thickness of the fusion parts 13 is 20 μm or less could be obtained. Therefore, the thickness of the fusion part 13 was set 3 μm or more and 20 μm or less so as to raise the adhesion strength of the buildup layer 11 with suppressing the deformation of the base of the subject body 1 from the novel first and second knowledge.

Meanwhile, horizontal axes of FIG. 3 and FIG. 4 indicate logarithms of thicknesses of the fusion parts 13, a vertical axis of FIG. 3 indicates dimensionless numbers of adhesion strengths of the buildup layers 11, and a vertical axis of FIG. 4 indicates dimensionless numbers of deformation of the bases of the subject bodies 1.

(III) Lubricant Filling Step

Figure 2:
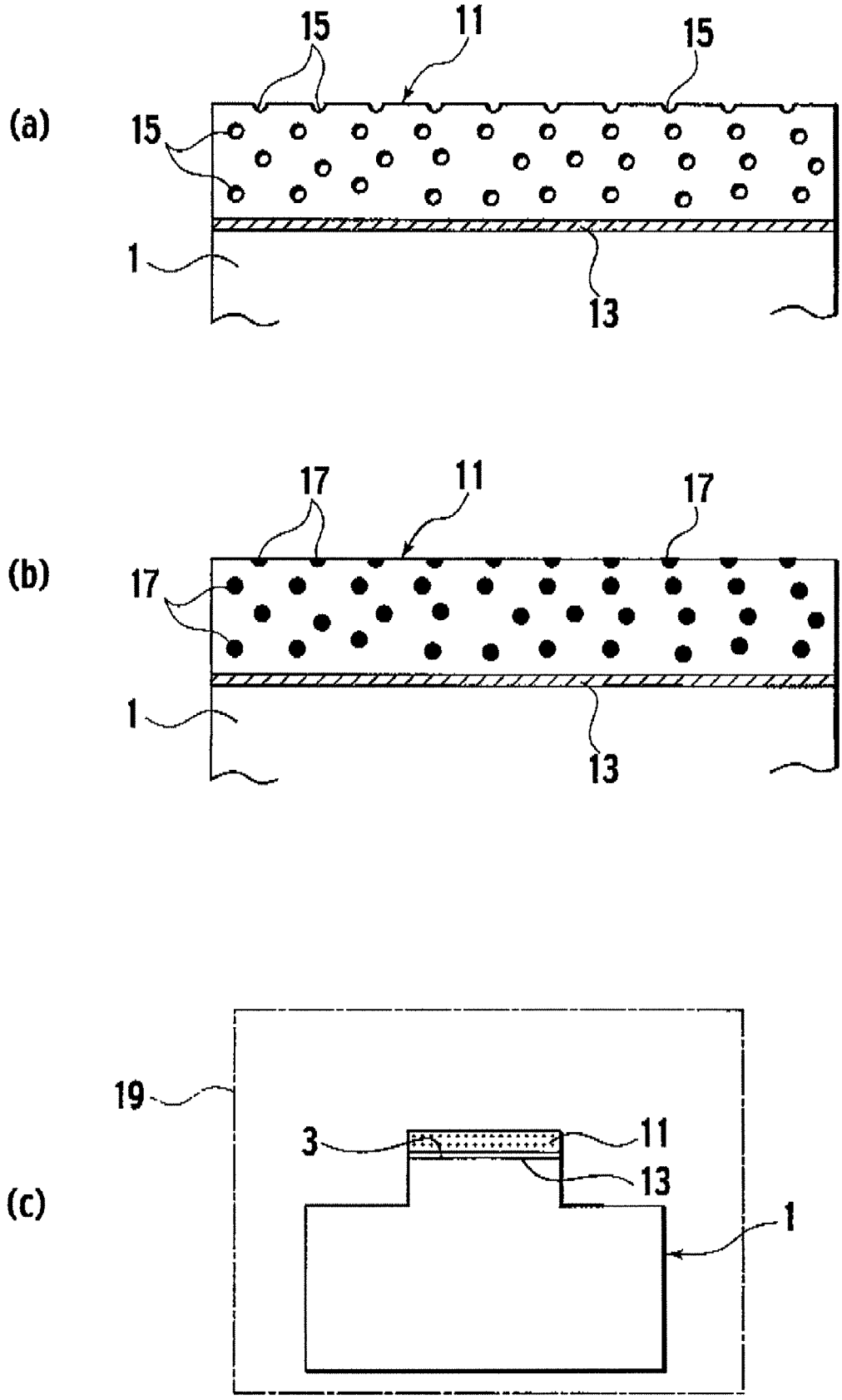
FIGS. 2(*a*) (*b*) (*c*) are drawings explaining the surface treatment method.

After finishing the (II) buildup layer formation step, the subject body 1 is detached from the electric spark machine. Then, as shown in FIGS. 2 (*a*) (*b*), a solid lubricant 17 is admixed with a liquid and filled in a plurality of pores 15 in the buildup layer 11 by means of rubbing with a brush. Meanwhile, the solid lubricant 17 consists essentially of hBN, $MOS_2$, $BaZrO_3$ or $Cr_2O_3$.

(IV) High-Temperature Keeping Step

After finishing the (III) lubricant filling step, as shown in FIG. 2(*c*), the subject body 1 is set at a predetermined site in a heat treatment furnace 19. Then the subject body 1 is heated in a vacuum or in the air so as to densify or oxidize the buildup layer 11 by means of the heat treatment furnace 19. While more detailed explanation will be given to the term "densify", whether densified or not can be clearly distinguished on the basis of morphologic observation in a macro or micro point of view.

Here, while temperature and time of heating required for densifying depend on a kind of a metal powder constituting the molded body, in a case where the metal powder is a powder of a Co alloy including Cr, a condition for keeping high-temperature in a vacuum is preservation at 1050 degrees C. for 20 minutes, and a condition for keeping high-temperature in the air is preservation at 760 degrees C. for 4 hours. However, when lubricity of the buildup layer 11 is required, the subject body 1 is made kept in high temperatures in the air for a predetermined time so as to oxidize Cr in the structure at least in part to provide $Cr_2O_3$, which is a solid lubricant, without deoxidizing the solid lubricant 17.

Meanwhile, heating may be carried out in any oxidizing atmosphere other than the air.

After forming the buildup layer 11 composed of a porous structure on the subject portion 3 of the subject body 1, a diffusion phenomenon between the subject portion 3 of the subject body 1 and the buildup layer 11 and a diffusion phenomenon among particles in the buildup layer 11 are brought about by keeping the subject body 1 in high temperatures in a vacuum or in the air for a predetermined time by means of the heat treatment furnace 19 so as to increase bonding force between the subject portion 3 of the subject body 1 and the buildup layer 11 and bonding force among the particles in the buildup layer 11. In particular, in a case where the subject body 1 is made to be kept in high temperatures in oxidizing atmospheres such as the air for a predetermined time, substances constituting the buildup layer 11 are subject to oxidization to transform themselves into substances consisting essentially of oxide ceramics. The aforementioned term "densifying" encompasses meanings of improvement of bonding force by diffusion and generation of oxide ceramics by oxidization.

Further, after forming the buildup layer 11 of a porous structure, it can be enabled to decrease frictional resistance of the buildup layer 11 by means of the lubrication action of the solid lubricant 17 so as to suppress adhesion to an opposite member by filling the solid lubricant 17 in a plurality of pores 15 in the buildup layer 11.

Furthermore, as the thickness of the fusion part 13 is made 3 μm or more and 20 μm or less, the adhesion strength of the buildup layer 11 can be increased with suppressing deformation of the base of the subject body 1.

In accordance with the first embodiment as described above, as the diffusion phenomenon between the subject portion 3 of the subject body land the buildup layer 11 and the diffusion phenomenon among the particles in the buildup layer 11 are raised to sufficiently increase the boding force between the subject portion 3 of the subject body 1 and the buildup layer 11 and the bonding force among the particles in the buildup layer 11, tensile strength of the buildup layer 11 is increased as shown in Table 1 and, as occurrence of rupture becomes rarer if large tensile force acts on the buildup layer 11, quality of the subject body 1 after the surface treatment can be easily stabilized.

TABLE 1

TENSILE TEST RESULTS

| Heating condition | Tensile strength | |
|---|---|---|
| | Before heating | After heating |
| Kept in a vacuum at 1050 degrees C. for 20 minutes and subsequently kept at 760 degrees C. for 4 hours. | 17 MPa | 88 MPa |
| Kept in the air at 760 degrees C. for 4 hours. | 15 MPa | 64 MPa |

Further, as the adhesion strength of the buildup layer 11 can be increased while deformation of the base of the subject body 1 is suppressed, quality of the subject body 1 after the surface treatment can be further stabilized.

Moreover, as frictional resistance of the buildup layer 11 is decreased by means of the lubrication action of the solid lubricant 17 so as to suppress adhesion to an opposite member, abrasion resistance of the buildup layer 11 can be increased to improve quality of the subject body 1 after the surface treatment. In particular, in a case where the subject body 1 is made kept in high temperatures in an oxidizing atmosphere such as the air for a predetermined time, as the whole of the porous structure can be made oxidized to transform themselves into the buildup layer 11 of a structure mainly of oxide ceramics, oxidization resistance and thermal insulation are improved so that quality of the subject body 1 after the surface treatment is further improved.

A second embodiment of the present invention will be described hereinafter with reference to FIG. 5 through FIG. 9.

Figure 5:
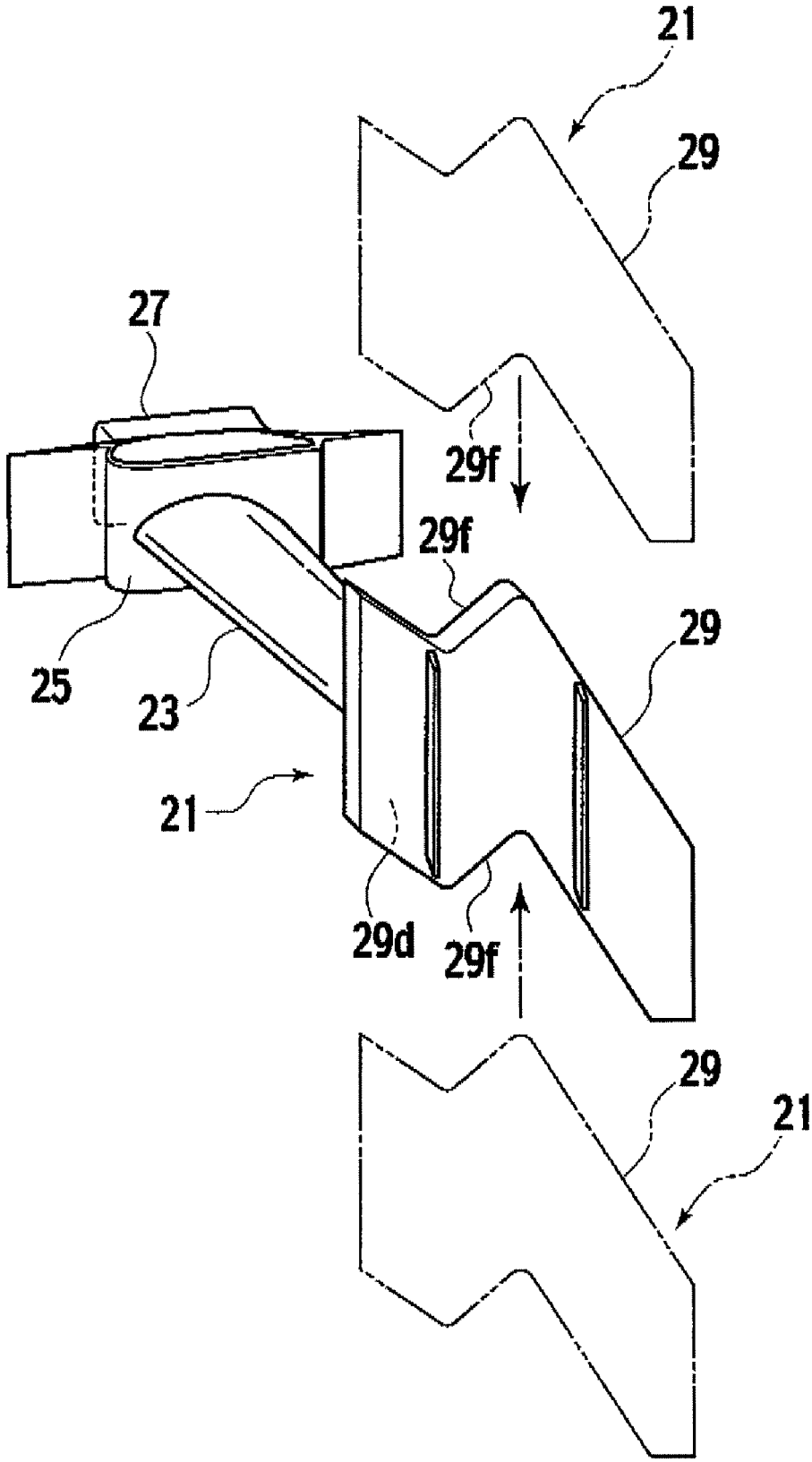
FIG. 5 is a perspective view of a turbine rotor blade as a subject body of the repair method in accordance with a second embodiment of the present intention.

As shown in FIG. 5, a turbine rotor blade 21 as a subject to repair by a repair method in accordance with the second embodiment is one of engine components used in a gas turbine engine such as a jet engine, and is provided with a blade 23, a platform 25 formed in a unitary body with a proximal end of the blade 23 and provided with inner flow paths, a dovetail 27 formed in a unitary body with the platform 25 and configured to fit with a dovetail groove (not shown) of a turbine disk, and a shroud 29 formed in a unitary body with a distal end of the blade 23 and provided with an outer flow path 29*d*.

Figure 6:
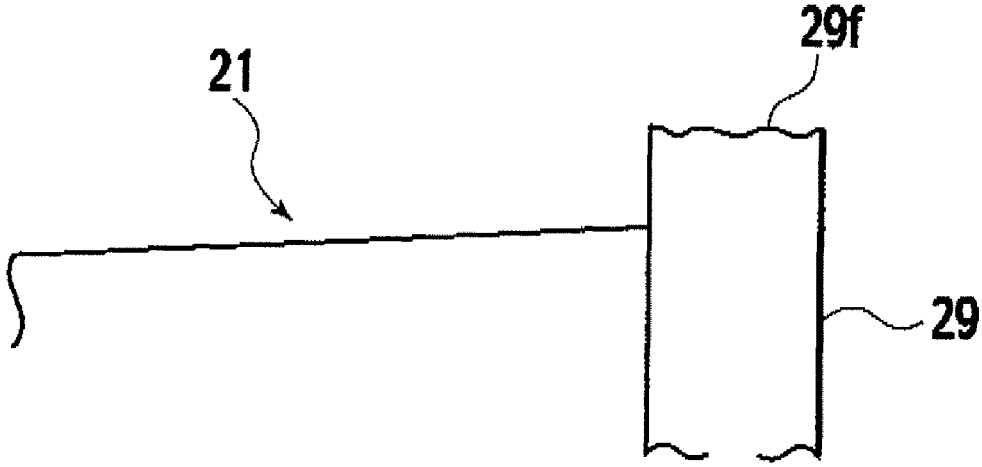
FIG. 6(*a*) is a schematic drawing showing a defect on an abrasion surface (a region subject to repair) of a shroud in the turbine rotor blade, and FIG. 6(*b*) is a drawing explaining the repair method.
Figure 6:
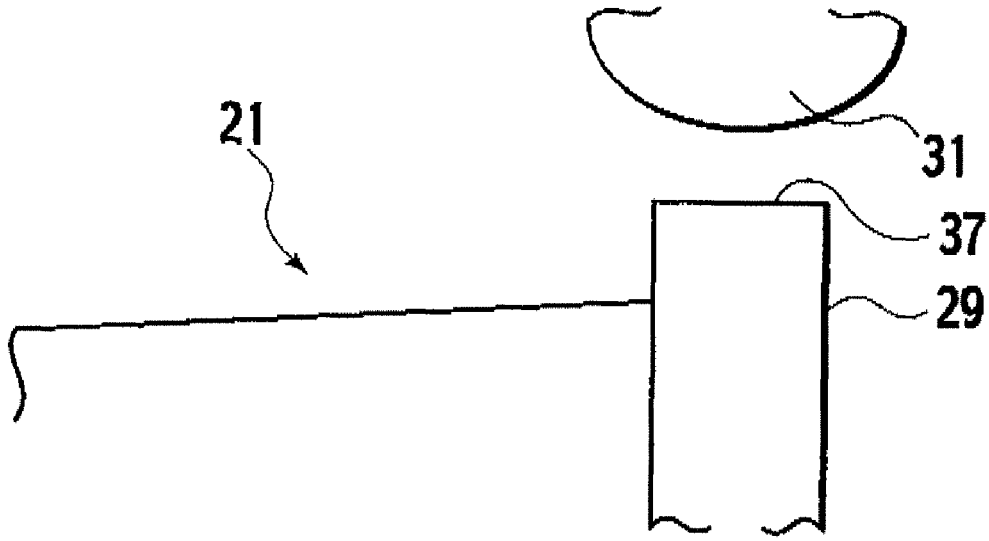

Here, as shown in FIG. 6 (*a*), as a pair of abrasion surfaces 29*f* of the shroud 29 of the turbine rotor blade 21 easily have defects such as wear caused by abrasion with an abrasion surface 29*f* of a shroud 29 of an adjacent turbine rotor blade 21, the abrasion surface 29*f* of the shroud 29 of the turbine rotor blade 21 is a portion subject to repair.

And, a repair method in accordance with the second embodiment is a method for repairing the abrasion surface 29*f* of the shroud 29 of the turbine rotor blade 21 and includes the following steps of a (i) defect removal step, a (ii) thin-film formation step, a (iii) buildup layer formation step, a (iv) lubricant filling step, a (v) high-temperature keeping step, and a (vi) size-finishing step (i) Defect Removal Step The turbine rotor blade 21 is set at a predetermined site in a grinder (most of the grinder will not be shown). Further, as shown in FIG. 6(*b*), a grindstone 31 of the grinder is rotated and then a portion including the defects generated in the abrasion surface 29*f* of the shroud 29 is removed by means of grinding. A surface made by removing the portion will be referred to as a removal portion 37.

Meanwhile, the portion may be removed by means of electric spark machining or such instead of grinding.

(ii) Thin-Film Formation Step

Figure 7:
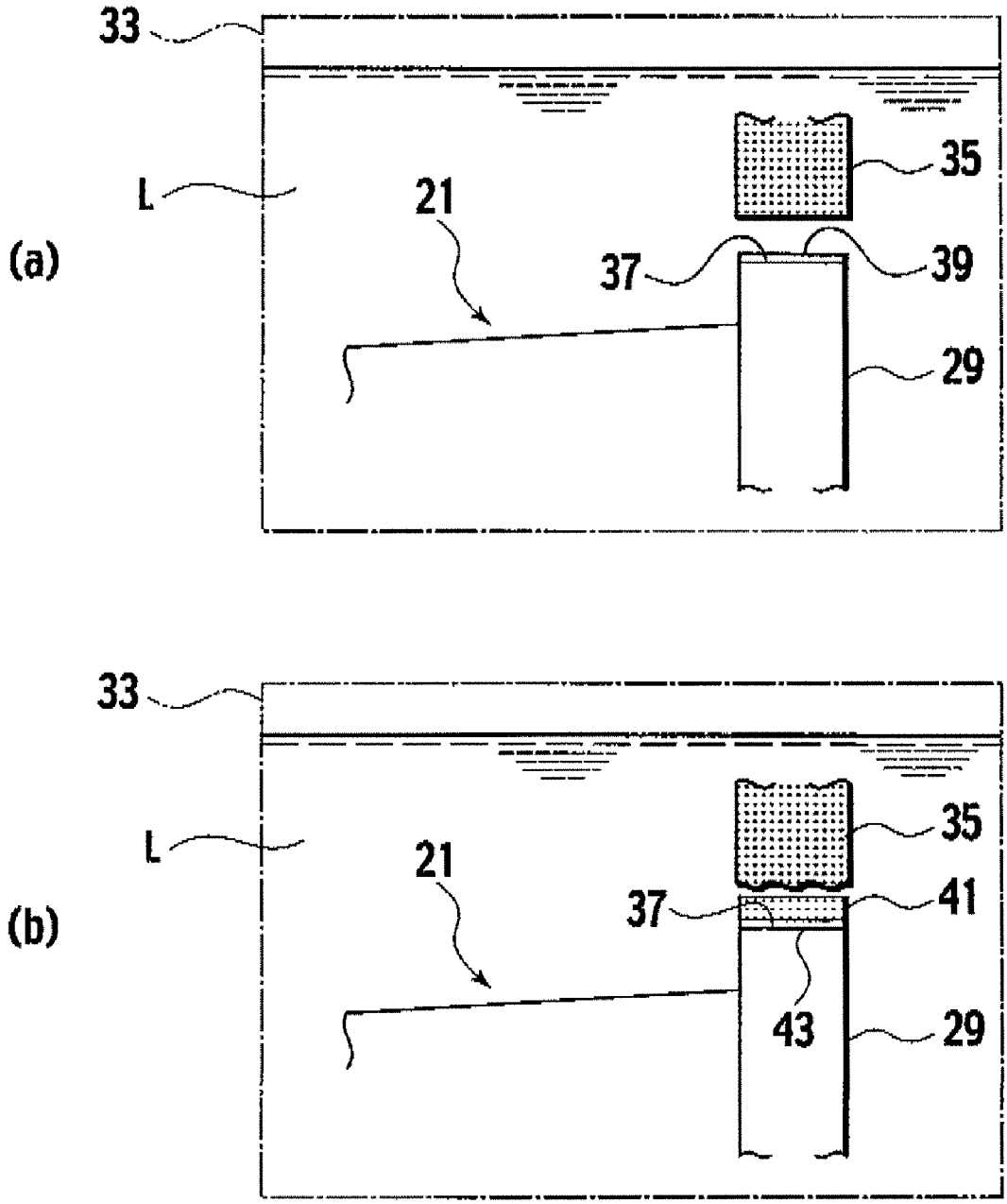
FIGS. 7(*a*) (*b*) are drawings explaining the repair method.

After finishing the (i) defect removal step, as shown in FIG. 7 (*a*), the turbine rotor blade 21 is detached from the predetermined site of the grinder and made closed to a working electrode 35 in a processing bath 33 of the electric spark machine. Then pulsing discharge is generated between the removal portion 37 of the shroud segment 29 and the working electrode 35 in an oil L stored in the processing bath 33. Thereby, a deposition by discharge deposition is formed as a thin film 39 on the removal portion 37 of the shroud 29. Meanwhile, the working electrode 35 is one similar to the working electrode 7 in accordance with the first embodiment.

(iii) Buildup Layer Formation Step

After finishing the (ii) thin-film layer formation step, as shown in FIG. 7(*b*), pulsing discharge is further generated between the removal portion 37 of the shroud 29 and the working electrode 7 in the oil L in the processing bath 33. Thereby, the thin film 39 is further made grow to form a buildup layer 41 on the removal portion 37 of the shroud 29. The buildup layer 41 usually has a porous structure.

Further, at a boundary between the buildup layer 41 and a base of the turbine rotor blade 21, a fusion part (fusion layer) 43 in which the composition ratio grades in its thickness direction is formed. The fusion part 43 is so constituted as to be 3 μm or more and 20 μm or less in thickness by selecting a proper discharge condition at a time of formation of the buildup layer 41. Meanwhile, the proper discharge condition may be that a peak current is 30 A or less and a pulse width is 200 μs or less, and more preferably that a peak current is 20 A or less and a pulse width is 20 μs or less.

Here, a ground on which the thickness of the fusion part 43 is 3 μm or more and 20 μm or less is, as with the fusion part 13 in accordance with the first embodiment, based on test results shown in FIG. 3 and FIG. 4.

(iv) Lubricant Filling Step

Figure 8:
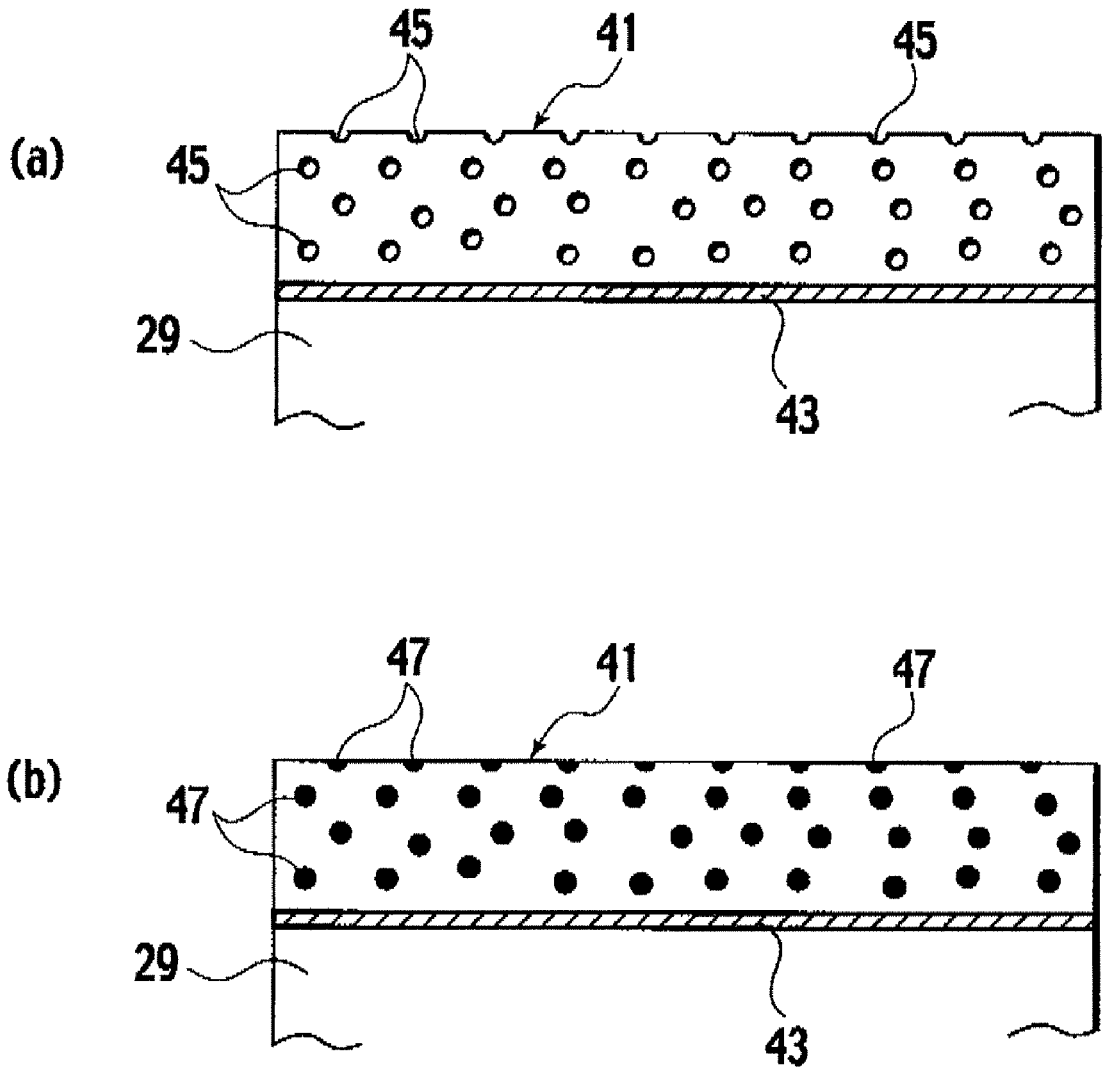
FIGS. 8(*a*) (*b*) are drawings explaining the repair method.

After finishing the (iii) buildup layer formation step, the turbine rotor blade 21 is detached from the electric spark machine. Then, as shown in FIGS. 8(*a*) (*b*), a solid lubricant 47 is admixed with a liquid and filled in a plurality of pores 45 in the buildup layer 41 by means of rubbing with a brush. Meanwhile, the solid lubricant 47 consists essentially of hBN, $MOS_2$, $BaZrO_3$ or $Cr_2O_3$.

(v) High-Temperature Keeping Step

Figure 9:
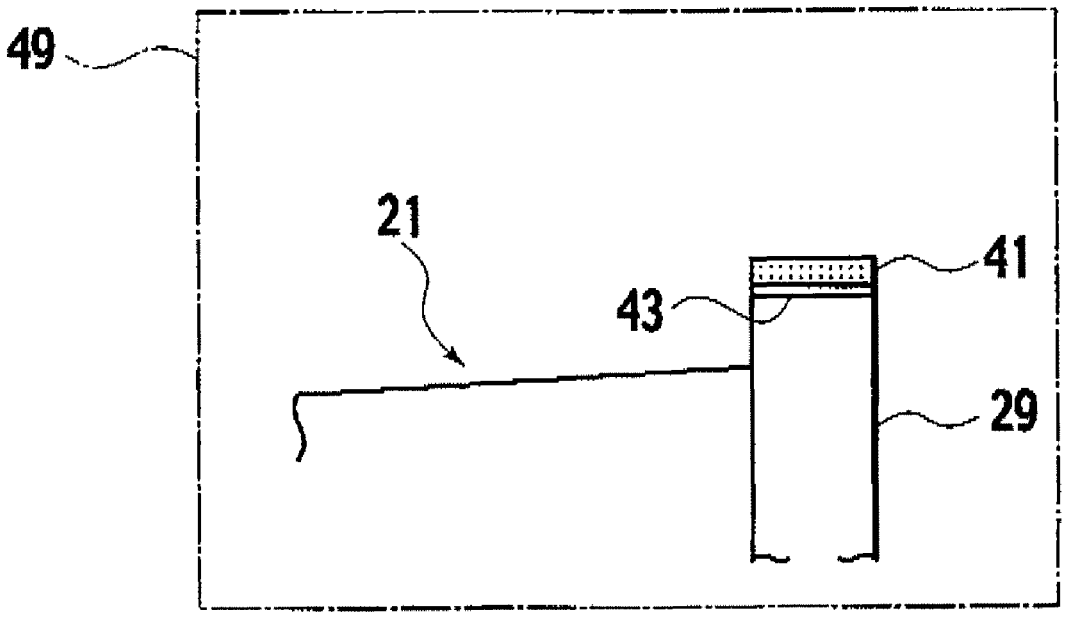
FIGS. 9(*a*) (*b*) are drawings explaining the repair method.
Figure 9:
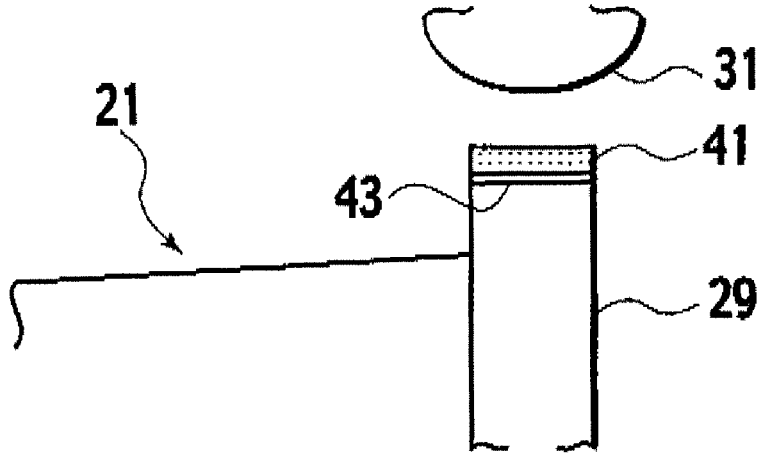

After finishing the (iv) lubricant filling step, as shown in FIG. 9 (*a*), the turbine rotor blade 21 is set at a predetermined site in a heat treatment furnace 49. Then the turbine rotor blade 21 is heated in a vacuum or in the air so as to densify the buildup layer 41 by means of the heat treatment furnace 49.

The meaning of the term "densify" is substantially identical to that in the first embodiment.

Here, while temperature and time of heating required for densifying depend on a kind of a metal powder constituting the molded body, in a case where the metal powder is a powder of a Co alloy including Cr, a condition for keeping high-temperature in a vacuum is preservation at 1050 degrees C. for 20 minutes, and a condition for keeping high-temperature in the air is preservation at 760 degrees C. for 4 hours. However, when lubricity of the buildup layer 41 is required, the turbine rotor blade 21 is made kept in high temperatures in the air for a predetermined time so as to oxidize Cr in the structure at least in part to provide $Cr_2O_3$, which is a solid lubricant, without deoxidizing the solid lubricant 47.

Meanwhile, heating may be carried out in any oxidizing atmosphere other than the air.

(vi) Size-Finishing Step

After finishing the (v) high-temperature keeping step, the turbine rotor blade 21 is detached from the predetermined site in the heat treatment furnace 49 and set at a predetermined site in the grinder. Further, as shown in FIG. 7(*a*), the grindstone 31 of the grinder is rotated and then the buildup layer 41 is grinded and finished by means of grinding so as to be a predetermined thickness.

Meanwhile, instead of grinding, electric spark machining may be carried out.

After forming the buildup layer 41 composed of a porous structure on the turbine rotor blade 21, a diffusion phenomenon between the removal portion 37 of the shroud 29 and the buildup layer 41 and a diffusion phenomenon among particles in the buildup layer 41 are brought about by keeping the turbine rotor blade 21 in high temperatures in a vacuum or in the air for a predetermined time by means of the heat treatment furnace 49 so that bonding force between the turbine rotor blade 21 and the buildup layer 41 and bonding force among the particles in the buildup layer 41 can be sufficiently increased.

Further, after forming the buildup layer 41 of a porous structure, it can be enabled to decrease frictional resistance of the buildup layer 41 by means of the lubrication action of the solid lubricant 47 so as to suppress adhesion to an opposite metal member by filling the solid lubricant 47 in a plurality of pores in the buildup layer 41.

Furthermore, as the thickness of the fusion part 43 is made 3 μm or more and 20 μm or less, the adhesion strength of the buildup layer 41 can be increased with suppressing deformation of the base of the turbine rotor blade 21.

Therefore, as the diffusion phenomenon between the removal portion 37 of the shroud 29 and the buildup layer 41 and the diffusion phenomenon among the particles in the buildup layer 41 are raised to sufficiently increase the boding force between the removal portion 37 of the shroud 29 and the buildup layer 41 and the bonding force among the particles in the buildup layer 41, tensile strength of the buildup layer 41 is increased. Thereby, as occurrence of rupture becomes rarer if large tensile force acts on the buildup layer 41, quality of the turbine rotor blade 21 after repair can be easily stabilized.

Further, as the adhesion strength of the buildup layer 41 can be increased while deformation of the base of the subject body 1 is suppressed, quality of the turbine rotor blade 21 after repair can be further stabilized.

Furthermore, as frictional resistance of the buildup layer 41 is decreased by means of the lubrication action of the solid lubricant 47 so as to suppress adhesion to an opposite metal member, abrasion resistance of the buildup layer 41 can be increased to improve quality of the turbine rotor blade 21 after repair.

Although the invention has been described above by reference to certain embodiments of the invention, the invention is not limited to the embodiments described above. Modifications and variations of the embodiments described above will occur to those skilled in the art, in light of the above teachings. Proper modifications, in one of which a gas having electric non-conductance is used instead of the oil L for example, may occur.

INDUSTRIAL APPLICABILITY

A dense coating or buildup of a ceramic can be easily formed by using electric discharge.

The invention claimed is:

1. A method for forming a coating on a limited site of a subject body, comprising:

applying one selected from the group of a compressed body of a powder of a metal and a sintered compressed body of a powder of a metal to a working electrode;

executing discharge deposition to deposit a first coating from the working electrode on the subject body by applying the subject body as a workpiece of the discharge deposition;

executing discharge deposition to deposit a second coating from the working electrode on the first coating by applying the subject body as a workpiece of the discharge deposition; and heating the subject body in one selected from the group of a vacuum, an air and an oxidizing atmosphere so as to densify the second coating or oxidizing the second coating at least in part to generate a solid lubricant substance.

2. The method of claim 1, further comprising:

filling a solid lubricant material in pores included in the coating before the step of heating.

3. The method of claim 2, wherein the solid lubricant material consists essentially of one selected from the group of hBN, $MoS_2$, $BaZrO_3$ and $Cr_2O_3$.

4. A component for a gas turbine engine, comprising the subject body of claim 1.

5. A gas turbine engine comprising the component of claim 4.

6. A method for producing a product repaired from a subject body including a defect, the method comprising;

removing a portion defining the defect of the subject body;

applying one selected from the group of a compressed body of a powder of a metal and a sintered compressed body of a powder of a metal to a working electrode;

executing discharge deposition to deposit a buildup from the working electrode on the subject body by applying the subject body as a workpiece of the discharge deposition; and heating the subject body in one selected from the group of a vacuum, an air and an oxidizing atmosphere so as to densify the buildup or oxidizing the deposition at least in part to generate a solid lubricant substance.

7. The method of claim 6, further comprising:

filling a solid lubricant material in pores included in the buildup before the step of heating.

8. The method of claim 7, wherein the solid lubricant material consists essentially of one selected from the group of hBN, $MoS_2$, $BaZrO_3$ and $Cr_2O_3$.

9. A component for a gas turbine engine, comprising the subject body of claim 6.

10. A gas turbine engine comprising the component of claim 9.

* * * * *